United States Patent [19]

Mars et al.

[11] 4,308,458

[45] Dec. 29, 1981

[54] FIRE DETECTORS UTILIZING AN IONIZATION CHAMBER NOT SUBJECT TO CONDENSATION OF WATER VAPOR DURING VARIATIONS OF TEMPERATURE

[75] Inventors: Jean Mars, Paris; Guy Roux, Massy, both of France

[73] Assignee: Commissariat a l'Energie Atomique, Paris, France

[21] Appl. No.: 72,610

[22] Filed: Sep. 5, 1979

[30] Foreign Application Priority Data

Sep. 11, 1978 [FR] France ..... 78 25999

[51] Int. Cl.[3] ..... H01J 39/28

[52] U.S. Cl. ..... 250/381; 250/384

[58] Field of Search ..... 250/381, 384, 238, 385; 340/629

[56] References Cited

U.S. PATENT DOCUMENTS 3,028,490 4/1962 Guilleux ..... 250/381

3,961,195 6/1976 Newington et al. ..... 250/385

*Primary Examiner*—Alfred E. Smith

*Assistant Examiner*—Carolyn E. Fields

*Attorney, Agent, or Firm*—Kerkam, Stowell, Kondracki & Clarke

[57] ABSTRACT

Condensation of water vapor on a radiation source in a fire detector is prevented by heating the source using the Joule effect. The heat is provided by a resistor embedded in the ceramic support for the source.

1 Claim, 4 Drawing Figures

FIRE DETECTORS UTILIZING AN IONIZATION CHAMBER NOT SUBJECT TO CONDENSATION OF WATER VAPOR DURING VARIATIONS OF TEMPERATURE

BACKGROUND OF THE INVENTION

The present invention relates to fire detectors using an ionization chamber as the essential detection agent.

It is well known to detect fires in a room or a given atmosphere by using an ionization chamber in the manner indicated hereinunder.

The atmosphere in which it is desired to monitor the possible appearance of signs of fire, such as for example smoke, is linked with the atmosphere of an ionization chamber in which the ambient air is ionized under the influence of the (generally $\alpha$) radioactivity produced by a radioisotope. In normal operation, this $\alpha$-emitting radioisotope causes a relatively stable and constant ionization within the chamber, so that a current is established between the two electrodes of said chamber and the intensity of said current is substantially constant provided that there is no disturbance of the chamber atmosphere. If, however, as a result of an incipient fire, smoke or fumes appear in the atmosphere and penetrate said chamber, said smoke will contain particles having a relatively high concentration and will exert a disturbing influence both on the formation and on the displacement of the ions within the ionization chamber. When said particles are ionized they are less mobile than ions from the ambient air. These heavy ions move much more slowly in the ionization chamber and there is a much greater chance of their recombining with an ion of opposite sign to give a neutral particle than in the case of ions from the ambient air. This increased recombination leads to a drop in the ionization current. In other words, the appearance of the combustion gas in the chamber leads to a significant increase in the apparent electrical resistance thereof. This drop in the ionization current then triggers off the fire alarm signal.

However, different disturbances tend to prevent correct operation of such a detector if a minimum of precautions are not taken. Firstly, the pressure and temperature variations of the external atmosphere can be corrected so that the rest current of the ionization chamber is independent of these two latter parameters. Conventionally, such a correction is obtained by fitting a compensation chamber in opposition with the actual detection chamber.

Although such a process is satisfactory for compensating variations in the pressure and temperature, it is inadequate for preventing the main cause of false alarms which is the condensation of water vapour on the radio isotope source following a sudden drop in the temperature when the atmosphere is very humid. Thus, the mean free path of $\alpha$ particles in air at ordinary pressure is 3 to 5 cm, whilst it is only 0.2 to 0.03 mm in water. When as a result of water vapour condensation on the source, the latter is covered with a film of liquid water, this leads to an abnormal absorption of the $\alpha$ radiation, which no longer fulfils its ionization function and consequently there can be large drop in the ionization current and in fact it can almost be eliminated. The detector then behaves as if it was filled with combustion gas and triggers off a false alarm. To obviate this difficulty, it has been proposed (see particularly French Pat. No. 1,185,495) to maintain the radioisotope source at a temperature slightly higher than ambient temperature by means of a heating wire and using the Joule effect. Unfortunately, in the hitherto known constructions, the heating wire was placed in the vicinity of the emitting surface of the source, turned towards the inside of the ionization chamber, which led to two serious disadvantages.

On the one hand, such an arrangement leads to the heating of the ionized medium within the ionization chamber and to the serious modification of the coefficient of mobility of the ions formed, which is directly dependent on the temperature. On the other hand, the interior of the chamber is thus directly subject to the influence of the electrical field created by the passage of the electrical current in the heating wire and this also disturbs the mobility and path of the ions formed.

BRIEF SUMMARY OF THE INVENTION

The present invention is directed at an improvement to this type of direct fire detector having a particularly simple construction and which prevents the disadvantages referred to hereinbefore of the heating of the emitting surface of the radioactive source to prevent condensation of the water vapour on the surface of said source, when sudden variations of temperature occur in a very humid atmosphere.

According to this improvement, the source which has an emitting surface turned towards the inside of the chamber is permanently maintained at a temperature above that in the chamber by heating using the Joule effect by means of an electrical resistor placed in contact with the rear non-emitting surface of said source.

According to the invention, the temperature excess imposed on the radioisotope source compared with the atmosphere of the chamber is at least 2° C.

According to a preferred embodiment of the invention, the filament resistor is embedded in the rear face of the source support. This arrangement makes it possible to completely obviate the disadvantages referred to hereinbefore of both the thermal and electrical action of the filament resistor relative to the ionized atmosphere of the chamber, because the heat produced is eliminated in the direction opposite to the source and the latter and its possible rear support form a shield relative to the electrical field produced by the current passing through the resistor.

According to another advantageous embodiment of the present invention, the resistor of the supply voltage regulating system of the actual chamber is used as the filament resistor of the radioisotope source, making it possible in this case to recover the heat otherwise dissipated as a pure loss in said resistor.

Obviously, the realisation of the improvement forming the object of the invention implies that the actual radioisotope source has a relatively good thermal conductivity with respect to the heating element. The thermal power required for this purpose is a function of a certain number of parameters such as for example the thermal resistances of the parts surrounding the source, as well as the temperature gradient in the vicinity of the detector containing the source. Account must also be taken of the speed of the surrounding air, which is liable to significantly change the thermal operating system of the detector and the source. Under normal conditions of use, it has been found that the electrical power required for each $cm^2$ of source was about 10 mW for obtaining a temperature increase of 4° C.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
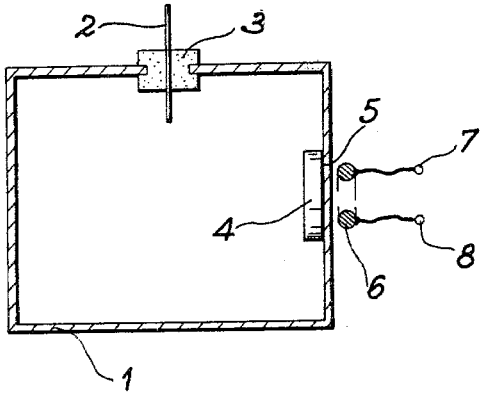
FIGS. 1 and 1*a* an ionization chamber equipped with a heating source according to the invention.

FIG. 1 shows an ionization chamber 1 with a collecting electrode 2 surrounding by an insulant 3, the latter being formed from a high resistivity dielectric material, such as e.g. Teflon. An α-emitting radioactive source 4 is placed in ionization chamber 2 and serves to ionize the atmosphere within the said chamber hypothetically freely communicating with the atmosphere to be monitored for fire. According to the invention, this radioisotope source 4 has on its rear face 5 an electrical resistor 6 permitting the passage of an electrical heating current from electrodes 7 and 8. Resistor 6 can be of a random type and is in particular deposited by a per se known chemical or physical process on the rear face 5 of source 4. As indicated hereinbefore, the electrical power necessary for obtaining the desired temperature rise of source 4 compared with the atmosphere of chamber 1 is dependent on the complete surface area of source 4, the thermal resistance of the latter compared with ionization chamber 1 (considered in the most unfavourable case as a continuous thermal radiator) and the various thermal losses of the installation. It is readily apparent that as a result of the structure shown, the thermal and electrical influence of resistor 6 on the atmosphere within chamber 1 is virtually 0.

Figure 1A:
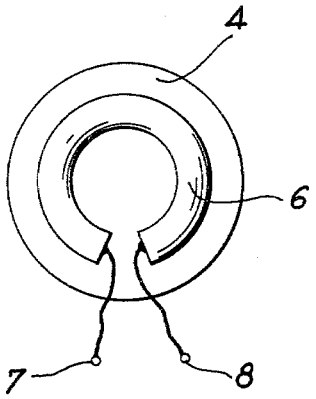

In the example of FIGS. 1 and 1*a*, the source 4 has a total surface of 1 $cm^2$ and its thermal resistance as a radiator is 200° C./Watt for a temperature rise of 4° C. compared with the atmosphere of chamber 1 it dissipates by radiation and convection 10 mW and by conduction 2 mW. Thus, the total electrical power required is 12 mW.

Figure 2:
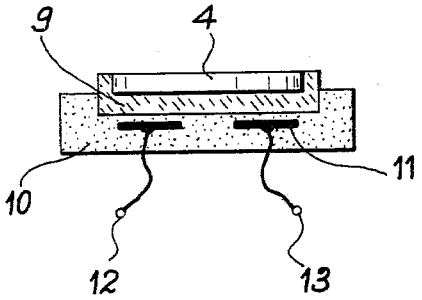
FIG. 2 a diagram showing in greater detail the possible construction of a radioisotope source equipped with a heating element according to the invention.

FIG. 2 shows a possible constructional embodiment of source 4 according to the improvement of the invention. In this construction, source 4 is stuck by means of an adhesive 9 to a ceramic support 10 which has a resistor 11, supplied by means of connections 12 and 13. This embodiment is particularly advantageous for the thermal and electrical protection of the atmosphere within the chamber 1.

Figure 3:
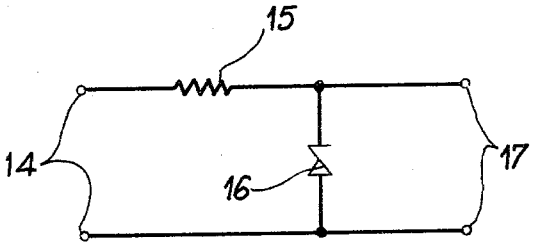
FIG. 3 an electrical diagram of a regulated supply system for such an ionization chamber.

FIG. 3 finally shows a possible embodiment of a voltage regulator for the constant voltage supply of an ionization chamber used as the fire detector, this being in spite of the potential drops occurring along the conductor wires. In the diagram of FIG. 3, the voltage of the system is applied to the input 14 of a T cell having a resistor 15 and a Zener diode 16.

The output voltage at 17 is regulated and constant in time. The interest of the embodiment of FIG. 3 is that it is possible to use resistor 15, which heats normally by the Joule effect as the resistor which heats the source 4. In this way, there is no need for a special resistor for heating the source, so that the energy which would otherwise have been lost is recovered by the Joule effect in resistor 15. Obviously, this example is illustrative and in no way limitative and it is possible to use the heat dissipated by any other regulating mode envisaged for regulating the supply voltage of the ionization chamber.

What is claimed is:

1. An improvement to fire detectors of the type comprising an ionization chamber having a radioisotope source with an emitting surface turned towards the inside of the chamber and which creates in the atmosphere of the chamber linked with the atmosphere to be monitored a substantially constant ionization, the said source being permanently maintained at a temperature above that in the chamber by the Joule effect using an electrical resistor in such a way as to prevent the condensation of water vapor on the source during the sudden temperature variations in a very humid atmosphere, wherein the electrical resistor is embedded in a ceramic support, said support being attached to the rear non-emitting surface of the source.

* * * * *